US008215238B2

(12) United States Patent
Roop

(10) Patent No.: US 8,215,238 B2
(45) Date of Patent: Jul. 10, 2012

(54) GUIDEWAY COUPLING SYSTEM

(75) Inventor: Stephen S. Roop, College Station, TX (US)

(73) Assignee: The Texas A&M University System, College Station, TX (US)

( * ) Notice: Subject to any disclaimer, the term of this patent is extended or adjusted under 35 U.S.C. 154(b) by 506 days.

(21) Appl. No.: 12/248,814

(22) Filed: Oct. 9, 2008

(65) Prior Publication Data

US 2009/0095192 A1 Apr. 16, 2009

Related U.S. Application Data

(60) Provisional application No. 60/978,946, filed on Oct. 10, 2007.

(51) Int. Cl.
*B60L 13/06* (2006.01)

(52) U.S. Cl. ..... 104/284

(58) Field of Classification Search ..... 104/118–121, 104/281, 284; 105/141, 144, 145; 188/267.1, 188/267.2

See application file for complete search history.

(56) References Cited

U.S. PATENT DOCUMENTS 3,807,313 A * 4/1974 Koyanagi ..... 104/291
5,845,581 A * 12/1998 Svensson ..... 104/120
6,202,806 B1 * 3/2001 Sandrin et al. ..... 188/267.1

FOREIGN PATENT DOCUMENTS

EP 1 726 503 A2 11/2006
WO WO 01/41551 A2 6/2001

OTHER PUBLICATIONS

PCT Notification of Transmittal of the International Search Report and the Written Opinion of the International Searching Authority, or the Declaration, regarding PCT Application No. US2008/079499 (14 pages), Jan. 19, 2009.

* cited by examiner

*Primary Examiner* — Joe Morano, IV
*Assistant Examiner* — R. J. McCarry, Jr.
(74) *Attorney, Agent, or Firm* — Baker Botts L.L.P.

(57) ABSTRACT

According to one embodiment, a pair of guideway engagement members having a controller circuit is configured on a transport vehicle that travels over an elongated guideway. The pair of guideway engagement members have a corresponding pair of bearing members that are each disposed on opposing sides of the guideway. The controller circuit receives a measurement indicative of dynamic movement of the transport vehicle from one or more sensors, and adjusts the stiffness of the pair of guideway engagement members according to the measurements received from the sensors.

21 Claims, 2 Drawing Sheets

GUIDEWAY COUPLING SYSTEM

RELATED APPLICATIONS

This application claims priority to U.S. Provisional Patent Application Ser. No. 60/978,946, entitled "GUIDEWAY CENTERING MECHANISM," which was filed on Oct. 10, 2007.

TECHNICAL FIELD OF THE DISCLOSURE

This disclosure generally relates to guideway systems, and more particularly, to a guideway coupling system for a transport vehicle that travels over a guideway.

BACKGROUND OF THE DISCLOSURE

A guideway system generally refers to a particular type of transportation system in which transport vehicles are configured move over one or more guideway rails. Guideway systems having a single guideway rail may also have a running surface or substrate for support of transport vehicles while the guideway rail serves to guide the transport vehicle along specified paths.

SUMMARY OF THE DISCLOSURE

According to one embodiment, a pair of guideway engagement members having a controller circuit is configured on a transport vehicle that travels over an elongated guideway. The pair of guideway engagement members have a corresponding pair of bearing members that are each disposed on opposing sides of the guideway. The controller circuit receives a measurement indicative of dynamic movement of the transport vehicle from one or more sensors, and adjusts the stiffness of the pair of guideway engagement members according to the measurements received from the sensors.

Some embodiments of the disclosure may provide numerous technical advantages. Some embodiments may benefit from some, none, or all of these advantages. For example, according to one embodiment, the guideway coupling system may enable enhanced control over the clearance between the linear induction motors and the guideway. The efficiency of the linear induction motors may be directly proportional to its clearance maintained between the guideway. This clearance however should be sufficiently wide due to dynamic perturbations encountered during movement along the guideway. The guideway coupling system may enable a relatively small clearance by controlling lateral movement of the linear induction motors in response to various dynamic perturbations.

Other technical advantages may be readily ascertained by one of ordinary skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

A guideway system incorporating a single rail or guideway may provide certain advantageous characteristics. For example, implementation of a single guideway may alleviate constant spacing requirements of other multi-rail designs. The single guideway may also be well suited for implementation of linear induction motors for propulsion along the guideway. Using linear induction motors, the guideway may function as the stator portion of the linear induction motors for motive force along the guideway system. To operate properly however, the clearance between the guideway and linear induction motor should be controlled.

Figure 1:
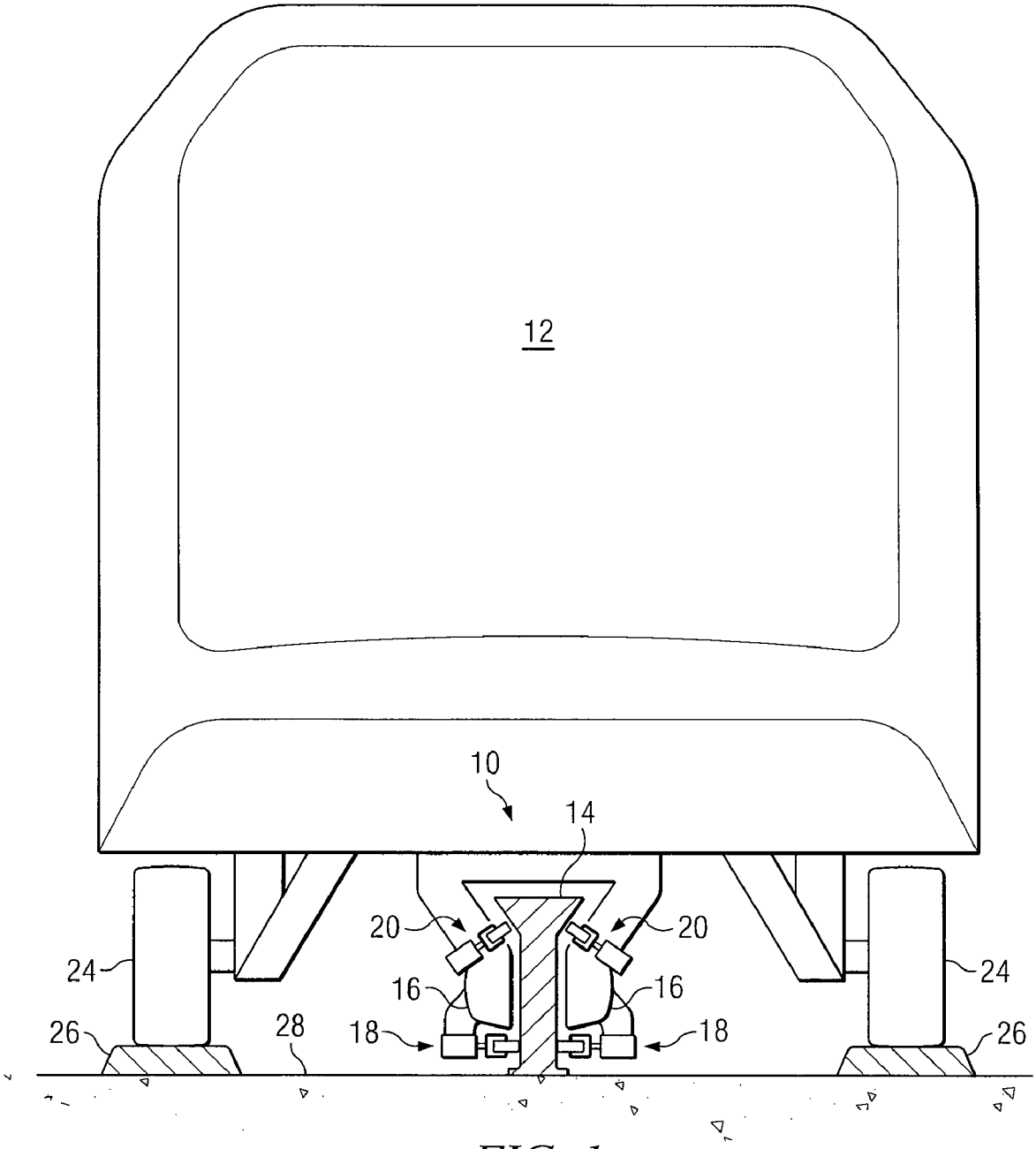
FIG. 1 is a front elevational view of a transport vehicle incorporating one embodiment of a guideway coupling system according to the teachings of the present disclosure.

FIG. 1 shows one embodiment of a guideway coupling system 10 that may be configured on a transport vehicle 12 for use on a guideway 14. Transport vehicle 12 is powered by a pair of linear induction motors 16 configured on either side of guideway 14. According to the teachings of the present disclosure, guideway coupling system 10 includes a pair of inwardly projecting guideway engagement members 18 for centering guideway 14 between linear induction motors 16 and a pair of diagonally oriented guideway engagement members 20 for preventing removal of guideway coupling system 10 from guideway 14.

Transport vehicle 12 may be any type of vehicle that is configured to move along guideway 14. Transport vehicle 12 generally includes wheels 24 for movement over elongated running surfaces 26 that extend in a substantially parallel relationship to the guideway 14. Running surfaces 26 and guideway are configured over a substrate 28, which may be any suitable material, such as concrete. Linear induction motors 16 configured on either side of the guideway 14 provide motive force for movement of transport vehicle 12 along guideway 14. In one embodiment, guideway 14 serves as a stator portion of the linear induction motor 16.

Guideway 14 controls the direction and path in which transport vehicle 12 travels. Guideway 14 may be formed of any suitable material that provides sufficient lateral stability for controlling the direction of the transport vehicle 12. In one embodiment, guideway 14 is formed of a combination of aluminum, iron, and concrete layers. In this arrangement, the aluminum layers provide relatively low electrical resistance for efficient power transmission to the linear induction motors 16 and the iron inner shell provides magnetic coupling for operation of linear induction motors 16.

Figure 2:
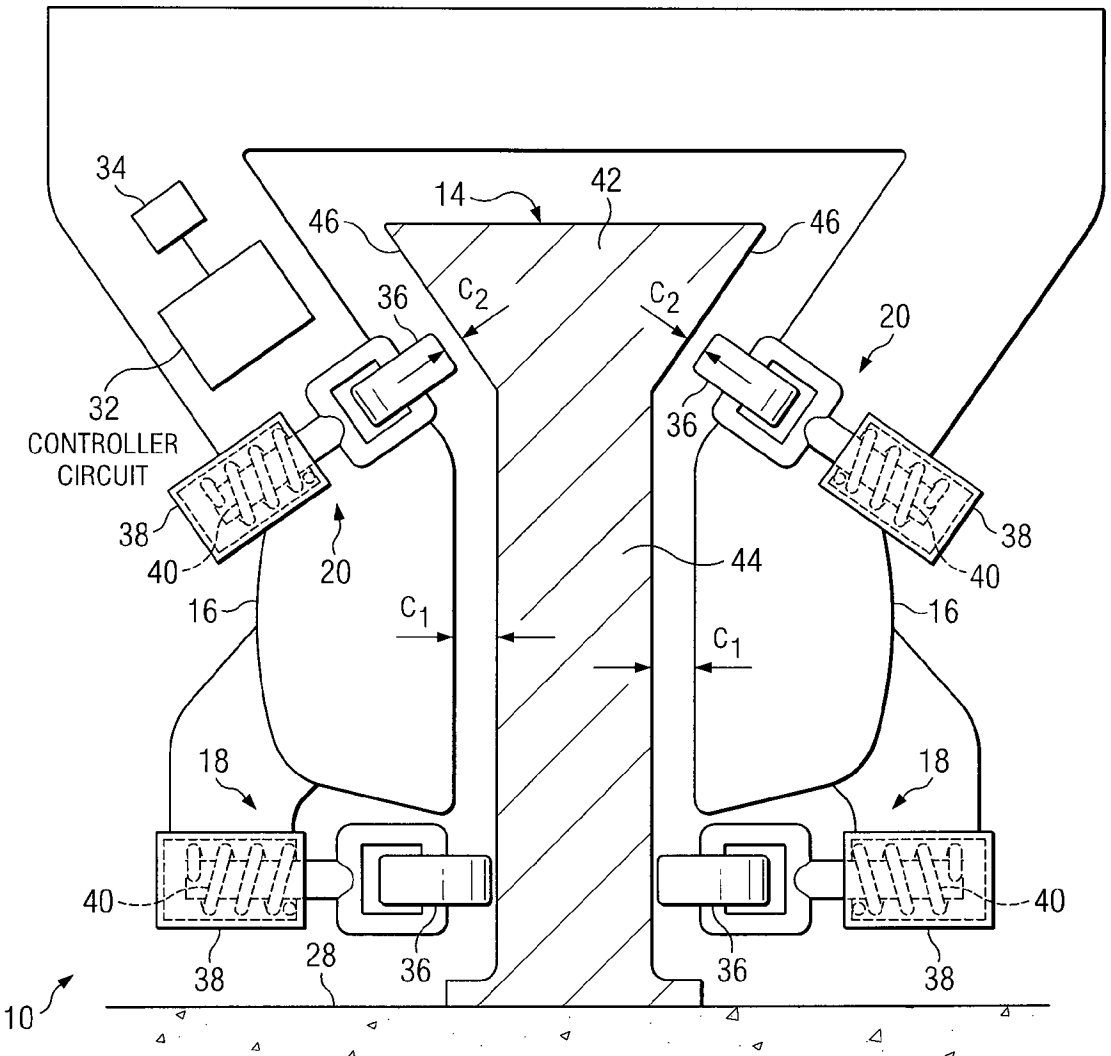
FIG. 2 is an enlarged front elevational view showing the arrangement of the guideway coupling system relative to the linear induction motors and guideway.

FIG. 2 is an enlarged partial view of transport vehicle 12 showing the arrangement of several elements of guideway coupling system 10. Guideway coupling system 10 includes a pair of inwardly projecting guideway engagement members 18 and a pair of diagonally oriented guideway engagement members 20 that may be configured on either side of guideway 14. Inwardly projecting guideway engagement members 18 maintain a clearance $C_1$ between the linear induction motors 16 and guideway 14 within specified limits, while diagonally oriented guideway engagement members 20 ensure that transport vehicle 12 remains on substrate 28. Guideway coupling system 10 also includes a controller circuit 32 that control inwardly projecting guideway engagement members 18 and diagonally oriented guideway engagement members 20 according to measurement obtained from one or more sensors 34 configured on transport vehicle 12.

In the particular, embodiment shown, each guideway engagement member 18 and 20 includes a roller 36 that is coupled to transport vehicle 12 through a shock absorber 38. Shock absorbers 38 may each include a spring 40. Rollers 36 provide relatively low friction for its respective guideway engagement member 18 or 20 during contact with guideway 14, while shock absorbers 38 provide resilient movement of rollers 36 relative to the linear induction motors 16 such that dynamic perturbations caused by movement along the guideway 14 may be dampened.

In one embodiment, inwardly projecting guideway engagement members 18 may be controlled by controller circuit 32 to maintain a clearance $C_1$ of linear induction motors 16 to guideway 14 that is 0.5 inches or less. This clearance may enable relatively good magnetic coupling of the linear induction motors 16 to the guideway 14. In the particular embodiment shown, rollers 36 are biased against guideway 14 using shock absorbers 38. In other embodiments, rollers 36 may be arranged to have a certain clearance from guideway 14 when shock absorbers 38 are in the fully extended position. With this clearance, rollers 36 may remain unengaged from the guideway 14 except when correction of the motor clearance $C_1$ is needed or desired.

Shock absorbers 38 have a stiffness that is adjustable by controller circuit 32. In one embodiment, shock absorbers 38 may be filled with a magneto rheological fluid to control its stiffness. A magneto rheological fluid is a substance having a viscosity that varies according to an applied magnetic field. Typical magneto Theological fluids include ferro-magnetic particles that are suspended in a carrier fluid, such as mineral oil, synthetic oil, water, or glycol, and may include one or more emulsifying agents that suspend these ferro-magnetic particles in the carrier fluid. Shock absorbers 38 may operate in the presence of a magnetic field to control their stiffness and thus, their stiffness. Thus, the relative stiffness of the shock absorber 38 may be controlled by an electrical signal from the controller 30.

Controller circuit 32 is operable to receive measurements from sensors 34 indicative of lateral and/or vertical dynamic movement of linear induction motors 16 at various frequencies. Given these measurements, controller circuit 32 may adjust the stiffness of shock absorber 38 to compensate for these dynamic perturbations. Sensors 34 may be any suitable device for converting measured lateral and/or vertical movement into an electrical signal suitable for use by controller circuit 32. In one embodiment, sensors 34 includes one or more accelerometers and one or more proximity switches that are mounted on transport vehicle 12.

Diagonally oriented guideway engagement members 20 may be provided to inhibit vertical removal of guideway coupling system 10 relative to guideway 14. Guideway 14 has an upper portion 42 integrally formed with a lower neck portion 44. Neck portion 44 is narrower in width than upper portion 42, thus yielding a upper surface 46 on either side of upper portion 42 that may be engaged by guideway engagement members 20 for maintaining transport vehicle 12 on substrate 28. Upper surface 46 may have any contour that faces at least partially downward for imparting a downward directed force when rollers 36 of guideway engagement members 20 make contact. In the particular embodiment shown, upper portion 42 has a generally trapezoidal shape with an upper surface 46 that is generally symmetrical on both sides of guideway 14. As shown, diagonally oriented guideway engagement members 20 are oriented in a generally diagonal direction for engaging upper surface 46 oriented in a generally similar orientation. In other embodiments, diagonally oriented guideway engagement members 20 and upper surface 46 may be oriented in any generally direction relative to one another such that engagement of diagonally oriented guideway engagement members 20 develop a downward directed force for maintaining transport vehicle 12 on guideway 14.

Rollers 36 of diagonally oriented guideway engagement members 20 may have a specified clearance $C_2$ from upper surface 46 when in the fully extended position. Thus, rollers 36 may remain free of contact with guideway 10 during normal operation and engage guideway 14 during excessive vertical movement of transport vehicle 12 relative to guideway 14. In one embodiment, the clearance $C_2$ of rollers 36 to guideway 14 may be adjusted by controller circuit 32 according to various operating conditions, such as speed, and or various terrain conditions encountered by movement of transport vehicle 12. For example, sensors 34 may detect angular movement of transport vehicle 12 due to a turning motion of transport vehicle 12. In response to this angular movement, controller circuit 32 may reduce clearance $C_2$ for reducing a level of lateral sway that may be experienced by transport vehicle 12. As another example, clearance $C_2$ and/or stiffness of shock absorbers 38 of guideway engagement members 20 may be adjusted by controller circuit 32 to compensate for varying speeds or the bumpiness of substrate 28. In this manner, guideway coupling system 10 may positively couple transport vehicle 12 to substrate 28 while not unduly affecting the normal operation of the suspension of transport vehicle 12 during transit.

Modifications, additions, or omissions may be made to guideway coupling system 10 without departing from the scope of the disclosure. The components of guideway coupling system 10 may be integrated or separated. For example, diagonally oriented guideway engagement members 20 may be integrated with inwardly projecting guideway engagement members 18 into a single pair of guideway engagement members such that each centers linear induction motors 16 on guideway 14 and resists vertical removal of transport vehicle 12 from substrate 28. Moreover, the operations of guideway coupling system 10 may be performed by more, fewer, or other components. For example, controller circuit 32 may be coupled to other sensors 34, such as various types of environmental measurement sensors including thermometers, precipitation, or other weather sensors for further tailoring operation of guideway coupling system 10 under various types of operating conditions. Additionally, operations of controller circuit 32 may be performed using any suitable logic comprising software, hardware, and/or other logic. As used in this document, "each" refers to each member of a set or each member of a subset of a set.

Figure 3:
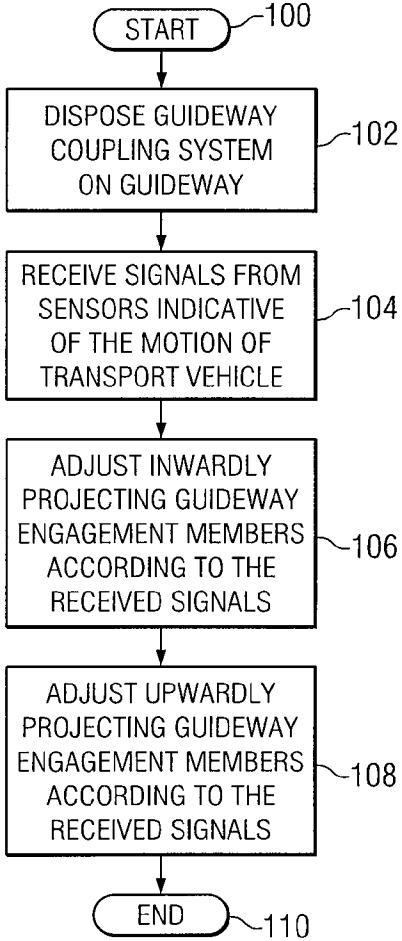
FIG. 3 is a flowchart showing one embodiment of a series of actions that may be performed by the controller circuit to maintain a clearance between the linear induction motors and the guideway within specified limits, and/or prevent vertical removal of the transport vehicle from the guideway.

FIG. 3 is a flowchart showing one embodiment of a series of actions that may be performed by controller 36 to maintain a specified clearance $C_1$ and/or prevent vertical removal of guideway coupling system 10 from guideway 14. In act 100, the process is initiated.

In act 102, guideway coupling system 10 is configured on a guideway 14. Guideway 14 may be any type of elongated guideway rail that is adapted for controlling the path and direction of transport vehicle 12 during transit. In one embodiment, guideway 14 serves as the stator portion of a pair of linear induction motors 16 configured either side for propulsion along guideway 14.

In act 104, controller circuit 32 receives signals from sensors 34 indicative of physical motion of transport vehicle 12 relative to guideway 14. Sensors 34 may include any device that generates measurements related to the physical position or other information associated with movement of transport vehicle 12 along guideway 14, such as, for example, accelerometers, proximity detectors, speedometers, and the like.

In act 106, controller circuit 32 adjusts shock absorbers 38 configured in inwardly projecting guideway engagement members 18 according to measurements received from sensors 34. In one embodiment, controller circuit 32 adjusts the stiffness of shock absorbers 38 to compensate for dynamic perturbations of transport vehicle 12 during movement along guideway 14. In other embodiments, controller circuit 32 may adjust other aspects of inwardly projecting guideway engagement members 18, such as their proximity of linear induction motors 16 to guideway 14.

In act 108, controller circuit 32 adjust diagonally oriented guideway engagement members 20 according to measurements received by sensors 34. In one embodiment, controller circuit 32 adjusts clearance $C_2$ according to measurements received from sensors 34, such as a speed of transport vehicle 12, or other orientation measurements indicating a lateral sway of transport vehicle 12. In this manner, diagonally oriented guideway engagement members 20 may inhibit vertical removal of guideway coupling system 10 from guideway 14 while reducing drag caused by continual contact of its associated rollers 36 on guideway 14.

The previously described actions 102 through 108 continue throughout movement of transport vehicle 12 along guideway 14. When operation of transport vehicle 12 is no longer needed or desired, the process ends in act 110.

Modifications, additions, or omissions may be made to the method without departing from the scope of the disclosure. The method may include more, fewer, or other acts. For example, digital circuitry of controller circuit 32 may also be used to adjust the clearance $C_1$ of linear induction motors 16 to guideway 14 to compensate for varying load levels or speed of transport vehicle 12. That is, the clearance $C_1$ may be adjusted according to measured speed or drive requirements under various loading conditions.

Although the present disclosure has been described in several embodiments, a myriad of changes, variations, alterations, transformations, and modifications may be suggested to one skilled in the art, and it is intended that the present disclosure encompass such changes, variations, alterations, transformations, and modifications as falling within the spirit and scope of the appended claims.

What is claimed is:

1. A guideway coupling system comprising:

a pair of inwardly projecting guideway engagement members configured on a transport vehicle that travels over an elongated guideway, the pair of inwardly projecting guideway engagement members having a corresponding pair of bearing members that arc each disposed on opposing sides of the guideway and operable to maintain a pair of linear induction motors disposed on either side of the guideway within a specified clearance from the guideway;

a pair of diagonally oriented guideway engagement members coupled to the transport vehicle and projecting inwardly toward to guideway, the diagonally oriented guideway engagement members operable to engage an upper contact surface of the guideway for inhibiting vertical removal of the transport vehicle from the guideway; and a controller circuit coupled to the pair of inwardly projecting guideway engagement members, the pair of diagonally oriented guideway members, and one or more sensors, the controller circuit operable to:

receive a measurement indicative of the dynamic variations in movement of the transport vehicle;

adjust a stiffness of the pair of inwardly projecting guideway engagement members according to a lateral portion of the dynamic variations; and adjust a stiffness of the pair of diagonally oriented guideway engagement members according to a vertical portion of the dynamic variations.

2. A guideway coupling system comprising:

a pair of guideway engagement members configured on a transport vehicle that travels over an elongated guideway, the pair of guideway engagement members having a corresponding pair of bearing members that are each disposed on opposing sides of the guideway; and a controller circuit coupled to the pair of guideway engagement members and one or more sensors, the controller circuit operable to:

receive a measurement indicative of the dynamic movement of the transport vehicle; and adjust a stiffness of the pair of guideway engagement members according to the received measurement.

3. The guideway coupling system of claim 2, wherein the pair of guideway engagement members comprise a pair of inwardly projecting guideway engagement members, the controller circuit operable to receive a measurement indicative of a lateral dynamic movement of the transport vehicle and adjust the stiffness of the pair of inwardly projecting guideway members according to the received measurement.

4. The guideway coupling system of claim 2, wherein the controller circuit is operable to maintain a pair of linear induction motors disposed on either side of the guideway within a specified clearance from the guideway.

5. The guideway coupling system of claim 4, wherein the specified clearance is less than or equal to 0.5 inches.

6. The guideway coupling system of claim 2, wherein each of the pair of guideway engagement members includes a magneto-rheological material that is operable to adjust the stiffness of the shock absorbers.

7. The guideway coupling system of claim 2, wherein each of the pair of guideway engagement members includes a spring.

8. The guideway coupling system of claim 2, wherein each of the pair of guideway engagement members includes a roller that is operable to make contact with the guideway.

9. The guideway coupling system of claim 2, wherein the two sides of guideway are symmetrical to one another and have an upper contact surface that faces at least partially downward, each of the pair of guideway engagement members being operable to engage the upper contact surface of the guideway for preventing vertical removal of the transport vehicle from the guideway.

10. The guideway coupling system of claim 2, wherein the pair of guideway engagement members comprise a pair of diagonally oriented guideway engagement members coupled to the transport vehicle and projecting inwardly toward the guideway, the controller circuit is operable to receive a measurement indicative of a vertical movement of the transport vehicle and adjust the pair of diagonally oriented guideway engagement members according to the received measurement.

11. The guideway coupling system of claim 9, wherein the guideway has a cross-sectional shape comprising a neck portion with a reduced width relative to an upper portion comprising the upper contact surface above the neck portion.

12. The guideway coupling system of claim 11, wherein the controller circuit is operable to adjust a clearance between the upper contact surface and the bearing members according to a loading of the transport vehicle.

13. The guideway coupling system of claim 11, wherein the upper portion has a trapezoidal shape.

14. A method for coupling a transport vehicle to a guideway comprising:

coupling each of a pair of guideway engagement members on either side of a guideway, the pair of guideway engagement members configured on a transport vehicle that travels over the guideway, the pair of guideway engagement members having a corresponding pair of bearing members that are each disposed on opposing sides of the guideway; and receiving a measurement indicative of a dynamic movement of the transport vehicle;

and adjusting a stiffness of the pair of guideway engagement members according to the received measurement.

15. The method of claim 14, wherein receiving the measurement comprises receiving the measurement indicative of a lateral dynamic movement of the transport vehicle and adjusting a lateral stiffness of the pair of guideway engagement members according to the received measurement.

16. The method of claim 14, further comprising maintaining a pair of linear induction motors disposed on either side of the guideway within a specified clearance from the guideway.

17. The method of claim 14, wherein maintaining the pair of linear induction motor within a specified clearance comprises maintaining the pair of linear induction motors within the specified clearance of less than 0.5 inches.

18. The method of claim 14, wherein adjusting the stiffness of the pair of guideway engagement members comprises adjusting the stiffness of a corresponding pair of shock absorbers comprising a magneto-rheological fluid in the pair of guideway engagement members.

19. The method of claim 14, wherein receiving the measurement comprises receiving the measurement indicative of a vertical dynamic movement of the transport vehicle and adjusting a vertical stiffness of the pair of guideway engagement members according to the received measurement.

20. The method of claim 14, further comprising inhibiting, using the pair of guideway engagement members, removal of the transport vehicle from the guideway, the two sides of the guideway being symmetrical to one another and having an upper contact surface that faces at least partially downward.

21. The method of claim 20, further comprising adjusting a clearance between the pair of guideway engagement members and the upper contact surface according to a loading of the transport vehicle.

* * * * *